US005378190A

United States Patent [19]

Young

[11] Patent Number: 5,378,190

[45] Date of Patent: Jan. 3, 1995

[54] ARTICULATED SOFT SCULPTURE AND METHOD OF MANUFACTURE

[76] Inventor: Pamela L. Young, 13319 NE. 39th, Vancouver, Wash. 98682

[21] Appl. No.: 61,995

[22] Filed: May 17, 1993

[51] Int. Cl.[6] ..... A63H 3/02; A63H 3/46

[52] U.S. Cl. ..... 446/371; 446/384

[58] Field of Search ..... 446/371, 370, 369, 375, 446/376, 381, 384, 390, 373, 97, 99

[56] References Cited

U.S. PATENT DOCUMENTS

| | | | |
|---|---|---|---|
| 1,050,793 | 1/1913 | Beedle | 446/381 |
| 1,273,538 | 7/1918 | Reeves | 446/384 |
| 1,754,558 | 4/1930 | Ivey | 446/371 |
| 2,544,135 | 3/1951 | Cohn | 446/384 |
| 2,725,234 | 11/1955 | Coble et al. | 446/97 X |
| 3,273,283 | 9/1966 | Wolf | 446/381 X |
| 3,377,819 | 4/1968 | Joy et al. | 446/376 X |
| 3,583,059 | 6/1971 | Ceolin | 446/97 X |
| 4,136,483 | 1/1979 | Shackelford et al. | 446/384 X |
| 4,356,659 | 11/1982 | Clarke | 446/97 |
| 4,820,234 | 4/1989 | Isaf | 446/321 |
| 4,950,912 | 8/1990 | Goldfarb et al. | 446/97 X |

FOREIGN PATENT DOCUMENTS

| | | | |
|---|---|---|---|
| 613014 | 11/1926 | France | 446/384 |
| 625573 | 9/1961 | Italy | 446/384 |

*Primary Examiner*—Robert A. Hafer
*Assistant Examiner*—D. Neal Muir
*Attorney, Agent, or Firm*—Klarquist Sparkman Campbell Leigh & Whinston

[57] ABSTRACT

A soft sculpture product and method of manufacturing the soft sculpture whereby a simplified and strong joint comprising a single mechanical fastener is used to joint a head, a body and arms. The head, body and arms are all independently rotatable.

3 Claims, 2 Drawing Sheets

ARTICULATED SOFT SCULPTURE AND METHOD OF MANUFACTURE

FIELD OF THE INVENTION

This invention relates to soft sculpture creations, and a method of manufacturing soft sculpture which includes, but are not limited to what are commonly called "stuffed animals." In particular, this invention relates to soft sculpture creations having a simplified and unique joint that allows the head, arms and body to rotate independently.

BACKGROUND OF THE INVENTION

Soft sculpture creations have been popular for many generations. While they are most normally associated with young children, there is a growing worldwide market composed of serious adult collectors for unique fine handcrafted soft sculpture creations made from expensive mohair and alpaca fur fabrics.

Designs for soft sculpture creations range from the very simple to the very complicated. One of the most simple designs is made by placing two pieces of fabric cut in a pattern atop each other like pancakes and sewing them together. Body appendages are defined by the stitching that outlines the appendages. The body and the appendages are then stuffed with a variety of material inserted into small openings that are sewn shut after the stuffing is completed. No rotational movement of the head, body, or appendages is possible. Creations designed and produced in this manner generally command a lower price and are of limited appeal to serious collectors.

More complex creations require cutting out and sewing many separate pieces of material to form discrete separate body parts that must then be joined together to form the finished creation. The most desirable method of joining the head and appendages is to create actual joints that allow the arms, legs, and body to be independently rotated.

It is generally true that more complex designed soft sculpture creations made from expensive real fur fabric are more expensive and more desirable. One indicia of a good soft sculpture is careful attention to detail and precision hand sewing. Another is whether or not the creation is jointed so that the head, body and appendages may be independently rotated.

One very old and simple method of jointing is called a button joint. A body and an appendage such as an arm or leg are jointed by placing a button on the interior of the body, against the fabric, and a button on the outside of the appendage to be jointed, and sewing the buttons together, the actual joint being formed by the thread. The obvious shortcoming of this method is its fragility. The thread may eventually deteriorate, or, more likely, the arm or leg will be rotated too many times and the joint will be twisted until it breaks. This jointing method is seldom used today. There are also buttons exposed on the outside of the appendage which are not only not very aesthetical pleasing, but tempting to young children.

The most popular soft sculptures today are jointing using mechanical fasteners such as nuts and bolts. After the individual parts of the soft sculpture are sewn, small holes are made in the body which correspond to where the appendages are to be placed. Small holes are then made in each appendage. Appropriate sized washers are then placed on the inside of the body and the inside of the appendage, the holes of the washers matching up with the holes in the fabric. A bolt is then put through the holes in the washers and the holes in the fabric. A nut is then threaded on the bolt and must be tightened. This process may be very unwieldy, difficult and time consuming. It requires that the holes in the appendages and body be precisely located as mirror images of each other. If the holes are not properly placed, the appendages may not both be at the same height, the feet or the palms may be rotated differently, or one of the appendages may be placed too far forward on the body. It is also very time consuming and difficult because of the tight spaces involved and the need to get a wrench inside the interior of both the appendage and the body to tighten the nut and bolt. Due to the extra effort and expense involved, joints that are made this way are far superior to the threaded button joint.

A variation of the above-mentioned jointing is the use of pop rivets in place of the nut and bolt. The process is very similar, the only difference being the use of a pop rivet in place of the nut and bolt. The problems are also similar. The pop rivet gun that is used is large and bulky. Pop rivets are also generally unsuitable for jointing larger soft sculpture creations.

What is needed is a method of jointing soft sculpture creations that produces soft sculpture having joints that are rotatable, strong, and simple to make. Both in the very competitive market of expensive high-quality, collectible soft sculpture and the mass market high production soft sculpture sold in retail outlets at low prices, a soft sculpture creation that has rotatable joints is more readily marketable and brings a higher price.

SUMMARY OF THE INVENTION

The present invention relates to an improved method of producing a soft sculpture creation that addresses the aforementioned problems and allows a strong, yet economical, rotatable joint to be made using simple techniques and inexpensive materials.

In a preferred embodiment, the method creates a rotatable jointed head, arms and body. After sewing the individual parts, a single mechanical fastener, such as a bolt, is used to attach the individual parts together. After the head, unitary arm unit and body have been sewn, holes large enough to accommodate the shank of a bolt are made in each piece. The shank of a bolt is inserted through the hole in the bottom of the head. Next, the shank of the bolt is inserted through the hole in the top of the body. A nut is then threaded in the shank of the bolt and tightened. The arm unit is thus sandwiched between the head and the body.

This method of jointing creates a joint that allows the head, arms and body to be individually rotated. The joint is strong and simple to produce, resulting in a soft sculpture that appeals to serious collectors and can be sold at a reasonable price.

The foregoing and other objectives, features, and advantages of the invention will be more readily understood upon consideration of the following detailed description of the invention, taken in conjunction with the accompanying drawings.

DETAILED DESCRIPTION OF THE DRAWINGS

Figure 1:
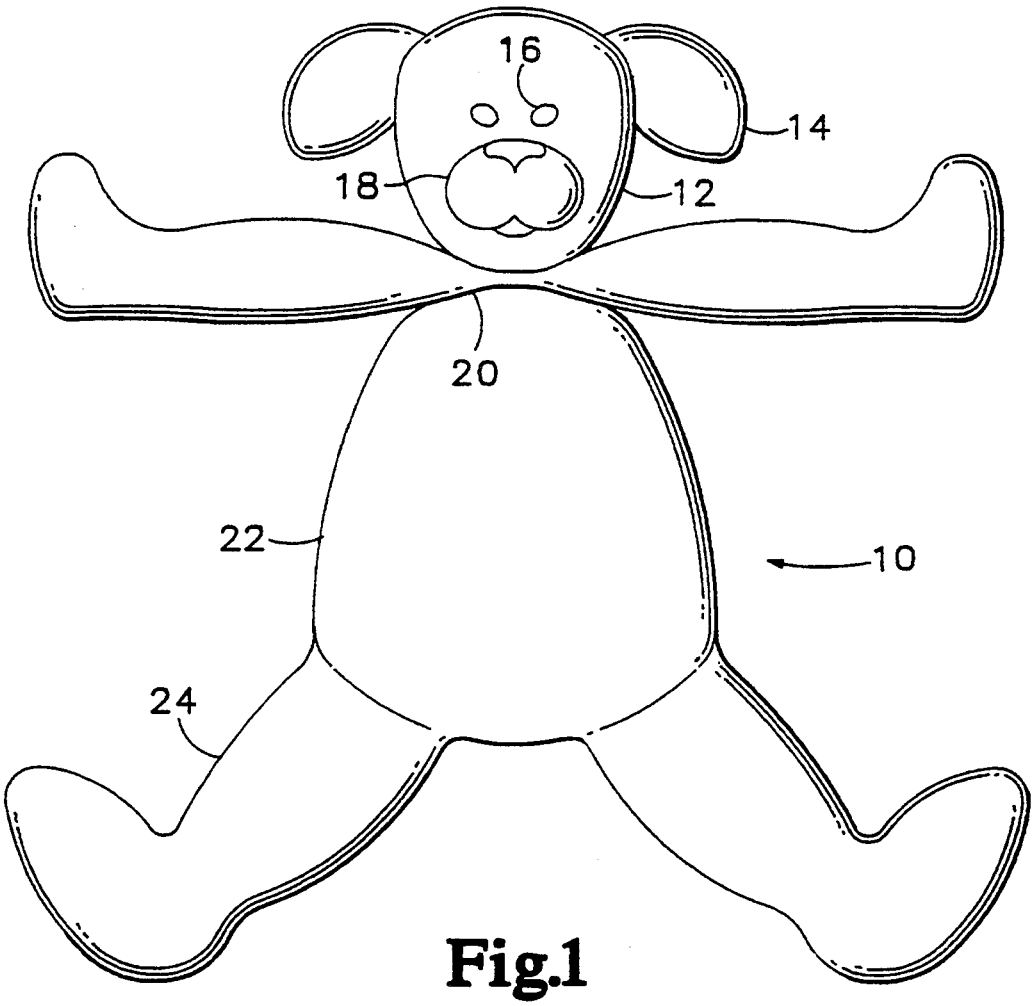
FIG. 1 is a front view of an illustrative embodiment of the soft sculpture produced according to the described method.

FIG. 1 is a front view of a completed soft sculpture 10, in this case a bear. The bear can be made from any number of fabric materials, but generally real fur fabric such as Angora or mohair results in the most valuable soft sculpture. The sculpture 10 has a head 12 with a pair of ears 14, a pair of eyes 16, and a nose 18. A unitary arm unit 20 is sandwiched between the head 12 and the body 22. The body has a pair of legs 24.

Figure 2:
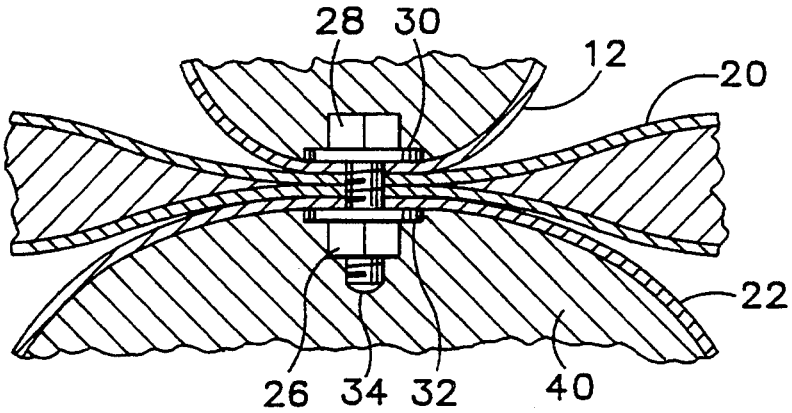
FIG. 2 is a partial sectional view of one embodiment of a joint of the present invention.

Referring now to FIG. 2, the head 12, the unitary arm units 20, and the body 22 are shown jointed by a nut 26 and bolt 28. After the body parts are sewn, they are aligned and small holes are made in each part. A washer 30 is placed on the interior of the head 12 with the hole in the washer aligning with the holes in the individual body parts. Another washer 32 is placed on the interior of the body 22 with the hole in the washer aligning with the hold in the individual body parts and the hole in washer 30. The shank 34 of the bolt 28 is placed through the washers 30, 32, and the holes in the individual pieces. A nut 26 is threaded onto the shank 34 of the bolt 28 and tightened. The nut should not be over tightened. The intention is to allow the head 12, unitary arm unit 20 and body 22 to rotate independently.

After the nut has been tightened, the head 12 and body 22 are stuffed with a cotton-like material 40. Other materials, such as small bearings or plastic beads may be used in conjunction with cotton material 40 to create a different feel in the finished soft sculpture.

Figure 3:
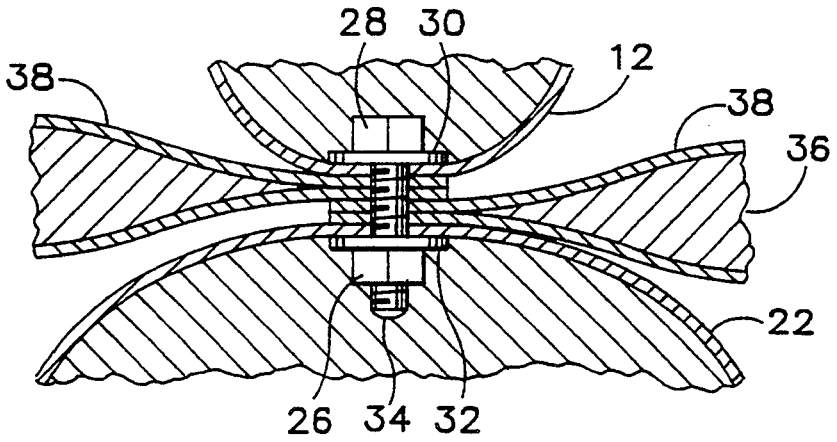
FIG. 3 is a partial sectional view of an alternative embodiment of the joint.
Figure 4:
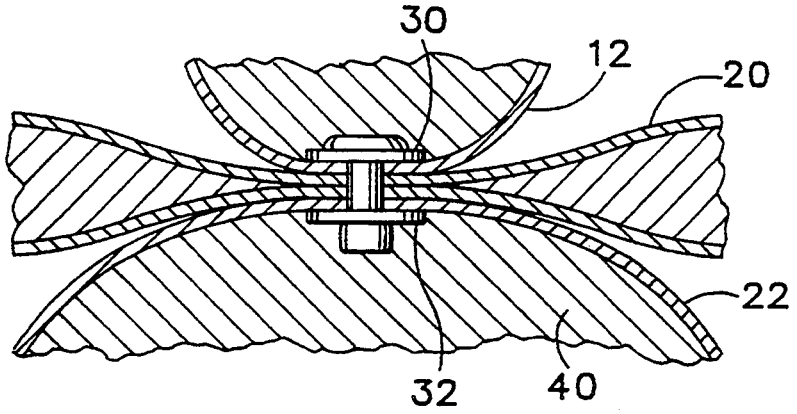
FIG. 4 is a partial sectional view of an embodiment of the joint of the present invention.

Referring now to FIG. 3, an alternative embodiment of the invention is shown. Rather than the unitary arm unit 20, as shown in FIG. 2, a central member 36 comprising at least two arms 38 is used. The same method of jointing described above is used.

There are nuts 26 and bolts 28 that have wide shoulders that could be used that would eliminate the need for washers 30 and 32. Other mechanical fasteners, such as a pop rivet, could also be used in place of nut 26 and bolt 28.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of manufacturing an articulated soft sculpture having a head, body, and limbs, said method comprising:

(a) forming a first aperture in a first piece of fabric;

(b) forming a second aperture in a second piece of fabric;

(c) forming a third aperture in a third piece of fabric;

(d) inserting a fastener through said first aperture, second aperture and third aperture;

(e) sewing and stuffing said first piece of fabric to form a head;

(f) sewing and stuffing said second piece of fabric to form a limb member having at least two limbs; and (g) sewing and stuffing said third piece of fabric to form a body, wherein said head, said limb member and said body may be rotated independently of each other.

2. The method of claim 1 wherein said fastener is a nut and bolt and said inserting step comprises inserting said bolt through said first aperture, second aperture and third aperture and then threading said nut on said bolt.

3. The method of claim 1 wherein said fastener is a pop rivet.

* * * * *